US006236423B1

(12) United States Patent
Yamaji

(10) Patent No.: US 6,236,423 B1
(45) Date of Patent: May 22, 2001

(54) THERMAL HEAD AND METHOD OF MANUFACTURING THE SAME

(75) Inventor: Norio Yamaji, Takamatsu (JP)

(73) Assignee: AOI Electronics Company Limited, Takamatsu (JP)

( * ) Notice: Subject to any disclaimer, the term of this patent is extended or adjusted under 35 U.S.C. 154(b) by 0 days.

(21) Appl. No.: 09/543,883

(22) Filed: Apr. 6, 2000

(30) Foreign Application Priority Data

May 31, 1999 (JP) ..... 11-150805
Jul. 28, 1999 (JP) ..... 11-212977

(51) Int. Cl.[7] ..... B41J 2/335
(52) U.S. Cl. ..... 347/203; 29/611
(58) Field of Search ..... 347/203, 200; 29/611

(56) References Cited

U.S. PATENT DOCUMENTS 5,745,147 * 4/1998 Johnson et al. ..... 347/203
5,847,744 * 12/1998 Hoki et al. ..... 347/203

FOREIGN PATENT DOCUMENTS 4-091960 * 3/1992 (JP) ..... 347/203
4-112048 * 4/1992 (JP) ..... 347/203
4-214367 * 8/1992 (JP) ..... 347/203
7-266594 * 10/1995 (JP) ..... 347/203
WO99/04980 * 2/1999 (WO) ..... 347/203

* cited by examiner

*Primary Examiner*—Huan Tran
(74) *Attorney, Agent, or Firm*—Kanesaka & Takeuchi

(57) ABSTRACT

In a thermal head, individual electrodes, a common electrode and a heating body are formed on an insulated base plate, and an insulating protective film is formed on the heating body. A conductive protective film is mounted on the insulating protective film to laminate on and connect with the common electrode. The conductive protective film has a thermal conductivity higher than that of the insulating protective film. Since the conductive protective film is connected to the common electrode, effects by static electricity due to friction with thermal-sensitive paper are prevented.

16 Claims, 6 Drawing Sheets

THERMAL HEAD AND METHOD OF MANUFACTURING THE SAME

BACKGROUND OF THE INVENTION AND RELATED ART STATEMENT

The present invention relates to a thermal head and a method of manufacturing the thermal head.

FIG. 9 shows a partial cross sectional view of an example of a thermal head in the prior art. In the thermal head in the prior art, an under-grazed layer 2 of glass or the like is formed on an electrically insulated ceramic base plate 1, such as alumina $Al_2O_3$; a common electrode 4 and individual electrodes 3 made of a conductive material, such as gold (Au), are formed thereon; and further a heating body 5 formed of oxidized ruthenium ($RuO_2$) is formed thereon.

Further, an insulating protective film 6 formed of a glass material, such as $PbO—SiO_2—ZrO_2$, for example, is formed almost all over the surface. A printing media, for example, thermal-sensitive paper 8 is carried by a platen roller 9 while being pressed with respect to the insulating protective film 6 in order to be colored by thermal transmission of heat of the heating body 5 through the insulating protective film 6.

FIG. 10 shows a partial plan view of the thermal head in the prior art.

As shown in FIG. 10, the printing media, such as thermal-sensitive paper, is colored by applying prescribed voltage between the common electrode 4 and the individual electrode 3 to heat a dotted portion of the heating body 5 located between a common lead electrode 4*a* and the individual electrode 3, the common lead electrode 4*a* extending from the common electrode 4.

Therefore, the insulating protective film 6 operates as a mechanical and electric protective layer. For this purpose, the film requires a certain mechanical strength and electric insulation.

The thermal head in the prior art, however, has problems that the insulating protective film 6 is prominently abraded due to pigments included in a thermal-sensitive layer of thermal-sensitive paper by friction with the paper as the printing media, and that the mechanical strength and electrical insulation of the insulating protective film 6 is hampered.

Furthermore, in labeling paper, since labeling paper is thick, pressurization of a platen roller 9 tends to be set high in order to match well with the thermal head.

In this case, high pressurization of the platen roller 9 promotes the abrasion of the insulating protective film 6. On the other hand, it was found in an experiment that anti-abrasion due to the friction of the insulating protective film 6 depends greatly on the printing duty when the thermal head prints letters on a printing media, such as thermal-sensitive paper 8.

Namely, abrasion amount tends to increase when the printing duty is higher than the low rate. Affects suffered by the thermal head in case of higher printing duty than the low rate show the highest temperature distribution at the central portion when heated by the heating element. And when the printing duty becomes higher, heat generated especially by repetition of successive printing is apt to be stored by synergy of heating resistor therearound. As a result of the temperature reaching near a transition point of the insulating protective film 6, the insulating protective film 6 can not keep its proper hardness and becomes sensitive to mechanical stress, such as friction. Accordingly, the printing media, such as thermal-sensitive paper, carry the insulating protected film 6 while being pressed by the platen roller 9, and anti-abrasion of the insulating protective film 6 is jeopardized.

To solve this problem, a method of forming a solid film, such as Si—Al—O—N, was proposed in accordance with Japanese Laid Open Publication (KOKAI) No. 4-214367, for example. However, in case of the solid film, such as Si—Al—O—N, a technique of forming the thin film, such as spattering, is required. When a prescribed thickness of a film is desired, it takes much longer time to form the film and it is impossible to do so at a low cost because targeted material is a solid film of Si—Al—O—N. Also, when the solid film of Si—Al—O—N or the like is formed on the protective film by a printing technology, a problem of peeling off of a layer occurs by stress between the protective film and solid film.

Further, since the printing media, such as thermal-sensitive paper, are carried while being pressed to the insulating protective film 6 by the platen roller, the insulating protect film 6 is destroyed by static electricity due to friction electricity with the printing media. As a result, resistance value of the heating body becomes irregular, so that the printing becomes inferior.

Further, the insulating protective film 6 is corroded by the affects of sodium ion $Na^+$ and potassium ion $K^+$ included in thermal-sensitive paper, which causes a problem of electric corrosion to deteriorate the electric insulation.

Furthermore, in the thermal head in the prior art, width to contribute to actual coloring is 150 $\mu$m relative to the width of 220 $\mu$m in a cross sectional direction, for example, because the heating body 5 is formed with the printing technology. Namely, the thickness of the heating body tends to be thin from the center toward the cross section thereof, and accordingly, as the resistance value at skirt portions in the cross sectional direction of the heating body is higher relative to the center, consumption of the power is limited at a lower level.

The object of the present invention is to provide a thermal head and a method of manufacturing the thermal head to improve efficiency of coloring while keeping mechanical and electric durability of the insulating protective film in order to solve the problems mentioned above.

SUMMARY OF THE INVENTION

A thermal head according to the present invention comprises individual electrodes, a common electrode and a heating body on an insulating base plate, and an insulating protective film is formed on the heating body. A conductive protective film having a thermal conductivity higher than that of the insulating protective film is provided on the insulating protective film, and the conductive protective film and the common electrode are connected.

Further, in manufacturing the thermal head, the conductive protective film with higher insulating protective film is formed on the insulating protective film, and the conductive protective film and the common electrode are laminated together.

DETAILED DESCRIPTION OF PREFERRED EMBODIMENTS

Figure 1:
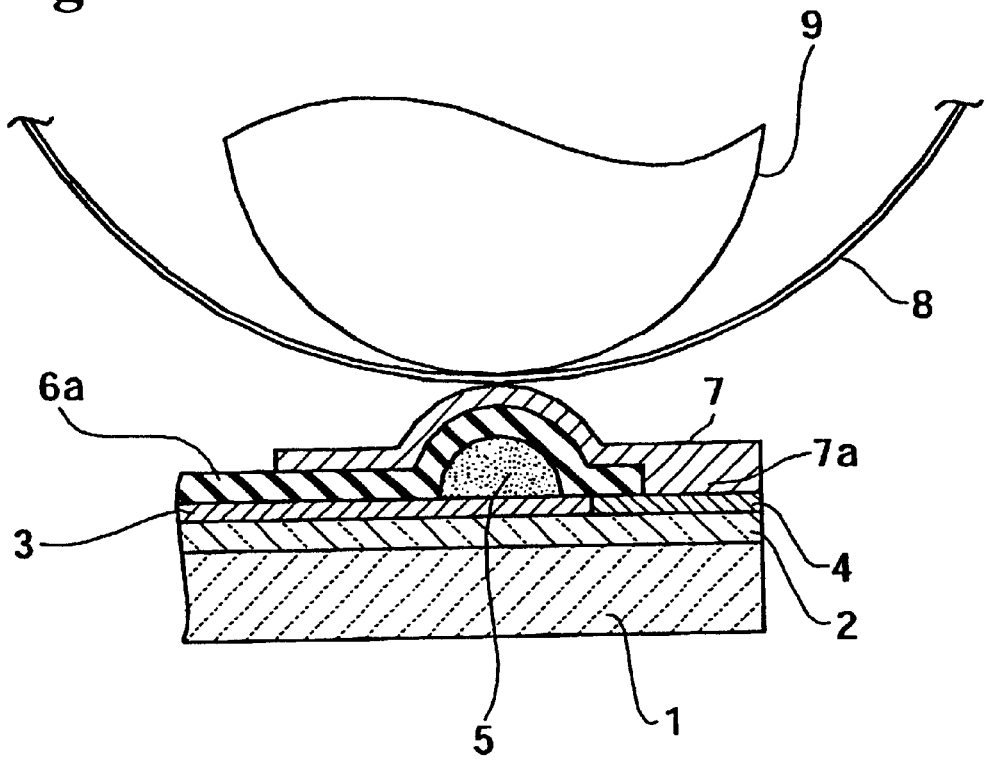
FIG. 1 is a partial cross sectional view of the thermal head according to the present invention.
Figure 2:
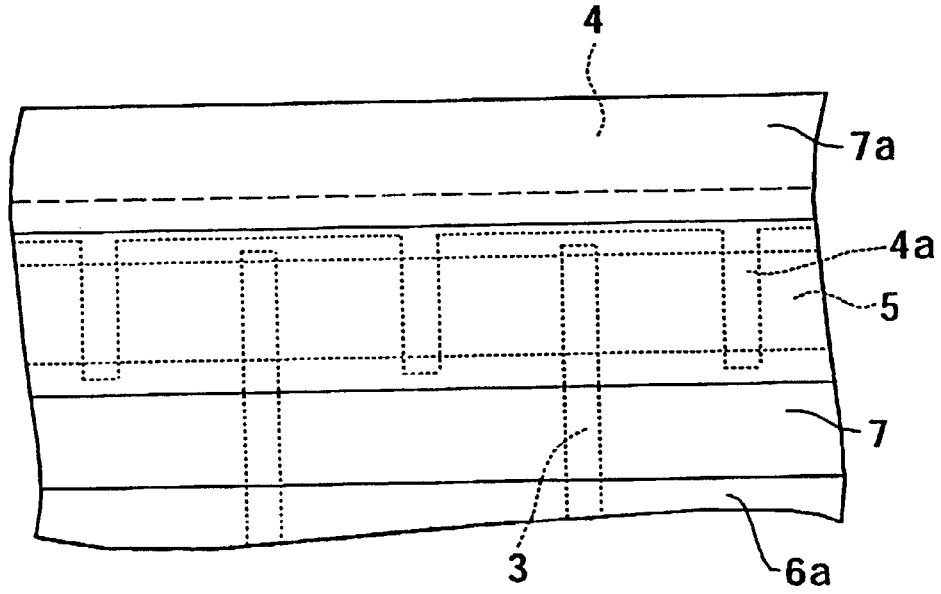
FIG. 2 is a partial plan view of the thermal head according to the present invention.
Figure 3:
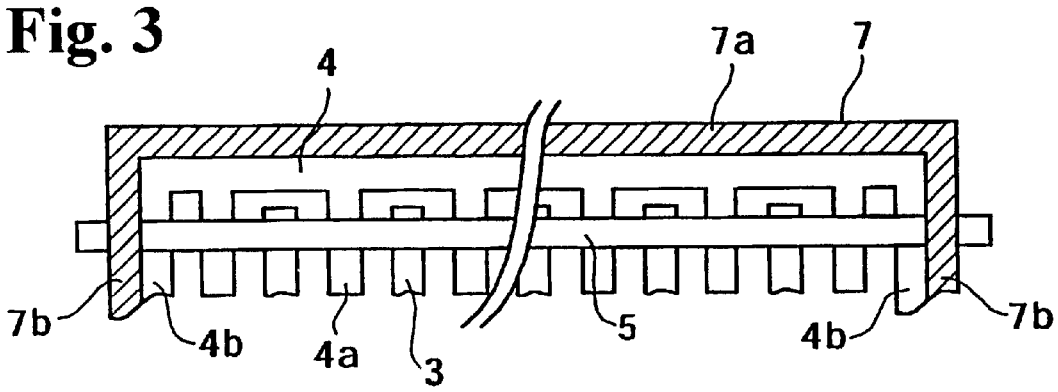
FIG. 3 is a schematic plan view of an embodiment of the thermal head according to the present invention.

Now referring to FIGS. 1 to 3, the first example of the present invention is described.

FIG. 1 shows a cross sectional view of the example of the present invention. FIGS. 2 and 3 show plan views of the example. The same reference numbers are assigned to the elements not changed in the prior art.

As shown in FIGS. 1, 2 and 3, under-grazed layer 2 of glass is formed on an upper surface of a ceramic base plate 1, and a conductive layer of gold (Au) or the like is formed on the whole surface by repeating the printing and sintering, and multiple individual electrodes 3 and a common electrode 4 are formed by photolithography such that individual electrodes 3 and common lead electrodes 4*a* extending from the common electrode 4 are arranged so as to intersect. Further, conductive materials made of silver (Ag) or the like are printed and sintered to overlap the common electrode 4, and a heating body 5 made of metal oxide of oxidized ruthenium (RuO2) is formed with certain width by printing and sintering to cover parts of the electrodes 3 and the common lead electrodes 4*a*.

Further, on the upper surface of the heating body 5, a glass material of $PbO—SiO_2—ZrO_2$ is printed to extend along and cover the heating body 5, and sintered at about 800° to form an insulating protective film 6*a*.

Further, on the insulating protective film 6*a*, conductive materials are printed and sintered to form a conductive protective film 7, the conductive materials being mainly made of oxidized ruthenium (RuO2), silicon (Si) or Zirconium (Zr) or lead (Pb), for example, and having sheet resistance value of 0.5M to 10 MΩ/□, preferably of 1MΩ/□ and softening temperature of about 650° C. As shown in FIG. 3, the conductive protective film 7 is electrically connected to have surface contacts at a conductive protective film portion 7*a* with the common electrode 4 formed almost in parallel with a heating body 5, and at the conductive protective film portions 7*b* with the common electrode portions 4*b* extending so as to intersect with the heating body 5 at both ends.

When the conductive protective film 7 is formed, sintering is conducted at a temperature of about 800° C., the same as that of an insulating protective film 6*a* just beneath the same. It was found in the experiment that the conductive protective film 7 can be formed with good adhesion to the insulating protective film 6*a* without peeling off if the material has a softening temperature of less than 750° C., preferably 650° C.

As a result, it is possible to manufacture the conductive protective film 7 while keeping sufficient sintering condition without disadvantages in which the heating body 5 diffuses, for example, to the insulating protective film 6*a* at the upper layer and irregularity of resistance value concurs since the temperature of sintering is the same as that of the insulating protective film 6*a* just beneath the protective film 7.

Further, the insulating protective film 6*a* is formed to open a part thereof such that through the part, the common electrode 4 and the common electrode portions 4*b* are electrically connected by surface contacts with the conductive protective film portion 7*a* and the conductive protective portions 7*b*, wherein the conductive protective film portion 7*a* extends throughout the common electrode 4 almost parallel to the heating body 5, and the conductive protective film portions 7*b* extend along the common electrode portions 4*b* intersecting with the heating body 5 at both ends thereof.

Figure 13:
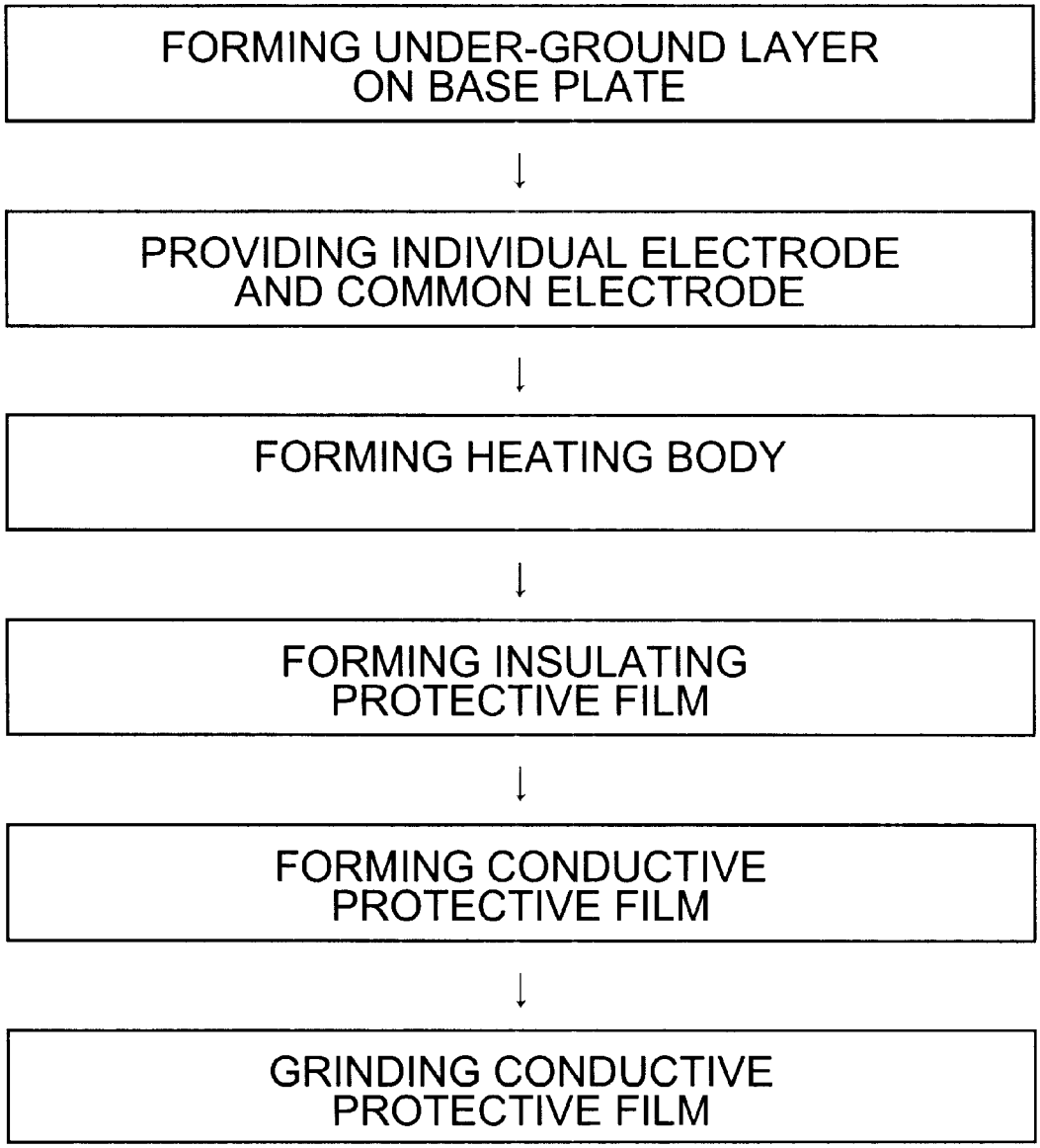
FIG. 13 show a forming process of the thermal head.

Furthermore, in order to increase close contact with a printing media, such as thermal sensitive paper 8, the circumference of the conductive protective film 7 formed at the upper-most portion (FIG. 1) is ground, including the portion of the conductive protective film 7 above the heating body 5 which is a contact surface, as shown in a process in FIG. 13. As a result, the close contact with the printing media, such as thermal sensitive paper, pressurized by a platen roller 9, can be maintained.

Selection of the sheet resistance value of 1MΩ/□ is restricted and set to an extent that change of the resistance value is negligible arising from the contact between the individual electrode 3 and common lead electrode 4*a*, and heating operation is not affected even if the heating body 5 contacts partially the conductive protective film 7 due to a bubble or pin hole formed in the materials of the insulating protective film 6*a* by printing and sintering.

On the other hand, the above-mentioned manufacturing method is effective when the insulating protective film 6*a* is constituted as a double layer structure in order to prevent electric leakage between the conductive protective film 7 of the upper layer and the heating body 5 due to the bubble or pin hole of the insulating protective film 6*a*.

As the conductive protective film 7 is connected electrically by surface contacts at the common electrode 4, common electrode portions 4*b*, and conductive protective films 7*a* and 7*b*, it is stable electrically, and can release instantaneously the static electricity generated partially by friction contact of the printing media, such as thermal-sensitive paper, with the conductive protective film 7 to the common electrode 4 and common electrode portions 4*b* near a portion where the static electricity is generated. At the same time, as the common electrode 4 and the conductive protective film 7 have a shield structure against the heating body 5, the static electricity is consumed as eddy current among the common electrode 4, common electrode portions 4*b*, and conductive protective film 7, so that the heating body 5 is protected from the static electricity.

Figure 4:
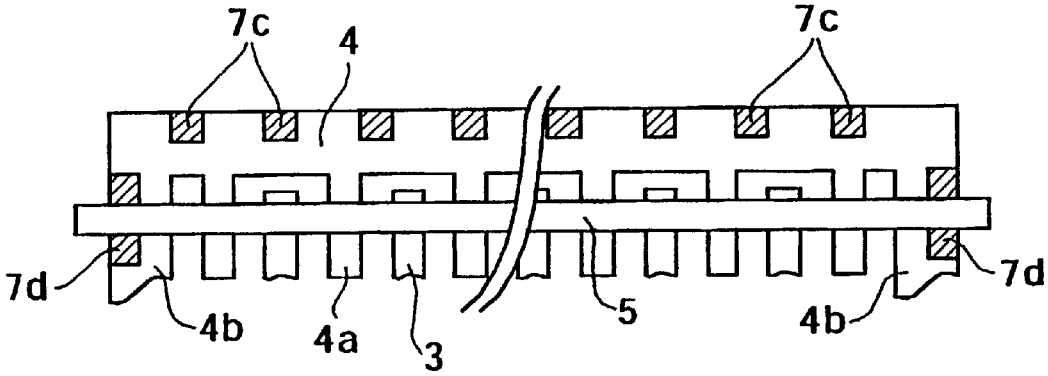
FIG. 4 is a schematic plan view of another embodiment of the thermal head according to the present invention.

Operations mentioned above act effectively even if the surface contacts of the conductive protective films 7*a* and 7*b* are maintained partly such that the conductive protective films 7*c* are formed discontinuously along the common electrode 4 extending generally parallel to the heating body 5, and the conductive protective films 7*d* are formed discontinuously along the common electrode portions 4*b* extending from both ends of the common electrode 4 to intersect the heating body 5, as shown in FIG. 4.

Further, the structure according to the present invention is effective for a problem of corrosion. That is, the heating body 5 is protected because sodium ion ($Na^+$) or potassium ion ($K^+$) flows into the common electrode 4 and common electrode portions 4*b* from the conductive protective film 7 nearby, the sodium or potassium ion causing dielectric breakdown of the insulating protective film 6. Also, the structure is effective for durability by corrosion.

In another embodiment, the same operation and effects are obtained even when the conductive protective film portions 7*a* and 7*b* are formed discontinuously, wherein the conductive protective film portions 7*a* and 7*b* are connecting positions with the common electrode 4, common electrode portions 4*b* and conductive protective film 7.

As shown in FIG. 4, the conductive protective films 7*c* and 7*d* are connected partially by surface contacts with the common electrode 4, wherein the conductive protective films 7*c* and 7*d* are formed discontinuously along a portion where the common electrode 4 extends generally parallel to the heating body 5, and along the common electrode portions 4*b* which extend from the common electrode 4 at both ends to intersect with the heating body 5.

Figure 5:
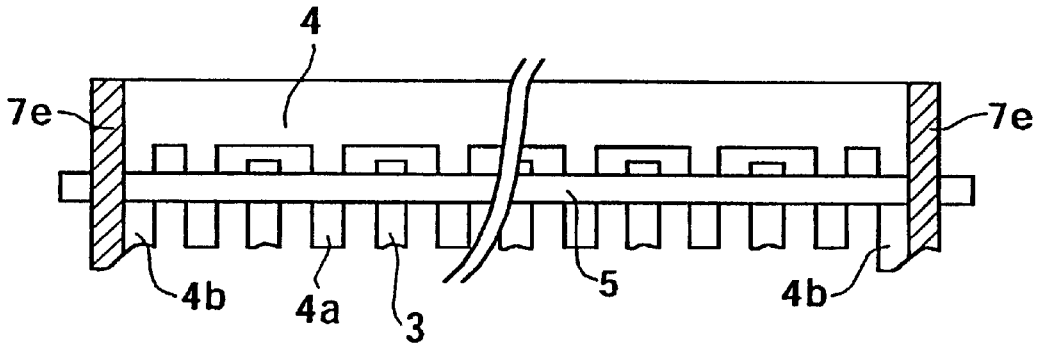
FIG. 5 is a schematic plan view of another embodiment of the thermal head according to the present invention.

Further, in another embodiment, as shown in FIG. 5, connecting positions of the common electrode 4 with the conductive protective film 7 are arranged such that the common electrode 4 is connected by continuous surface contact with conductive protective films 7*e* extending along the common electrode portions 4*b*, which extend from the both ends of the common electrode 4 to intersect the heating body 5 extending along the common electrode 4.

Figure 6:
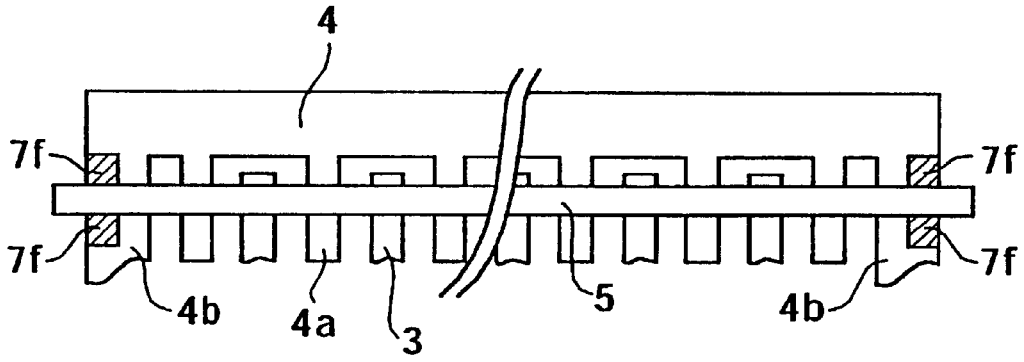
FIG. 6 is a schematic plan view of another embodiment of the thermal head according to the present invention.

Also, in another embodiment, as shown in FIG. 6, connecting positions of the common electrode 4 with the conductive protective film 7 are arranged such that the common electrode 4 is connected by partial surface contact with conductive protective films 7*f* extending along the common electrode portions 4*b*, which extend from both ends of the common electrode to intersect the heating body 5 extending along the common electrode 4.

Figure 7:
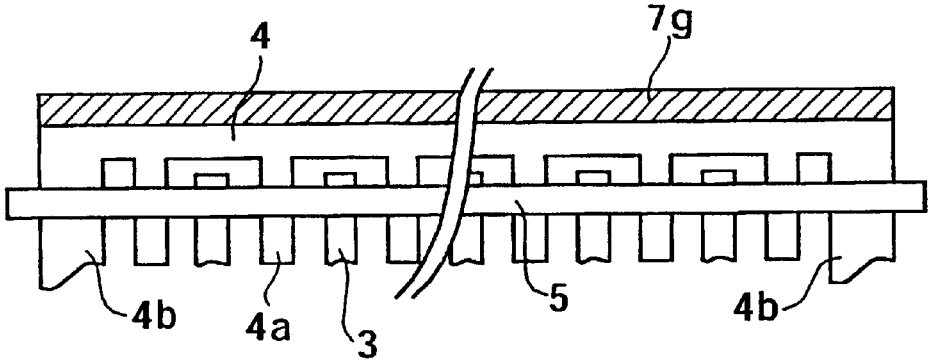
FIG. 7 is a schematic plan view of another embodiment of the thermal head according to the present invention.

Further, as shown in FIG. 7 as another embodiment, a conductive protective film 7*g* which is a connecting portion of the common electrode 4 with the conductive protective film 7 is connected by continuous contact with the common electrode 4 along a portion where the common electrode 4 extends generally parallel to the heating body 5.

Figure 8:
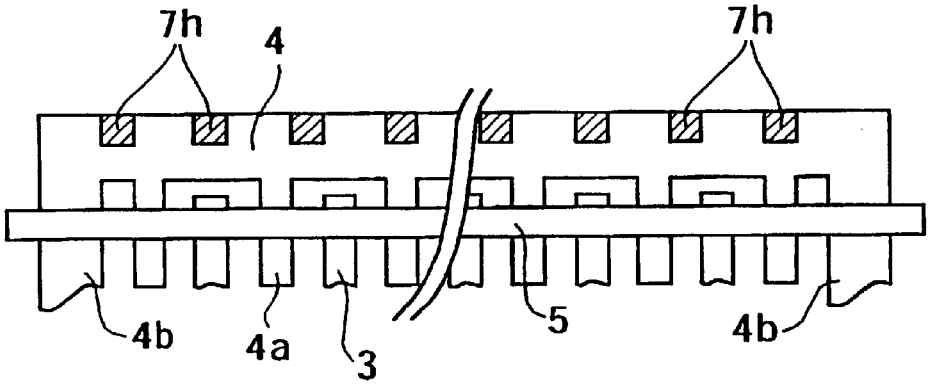
FIG. 8 is a schematic plan view of another embodiment of the thermal head according to the present invention.
Figure 9:
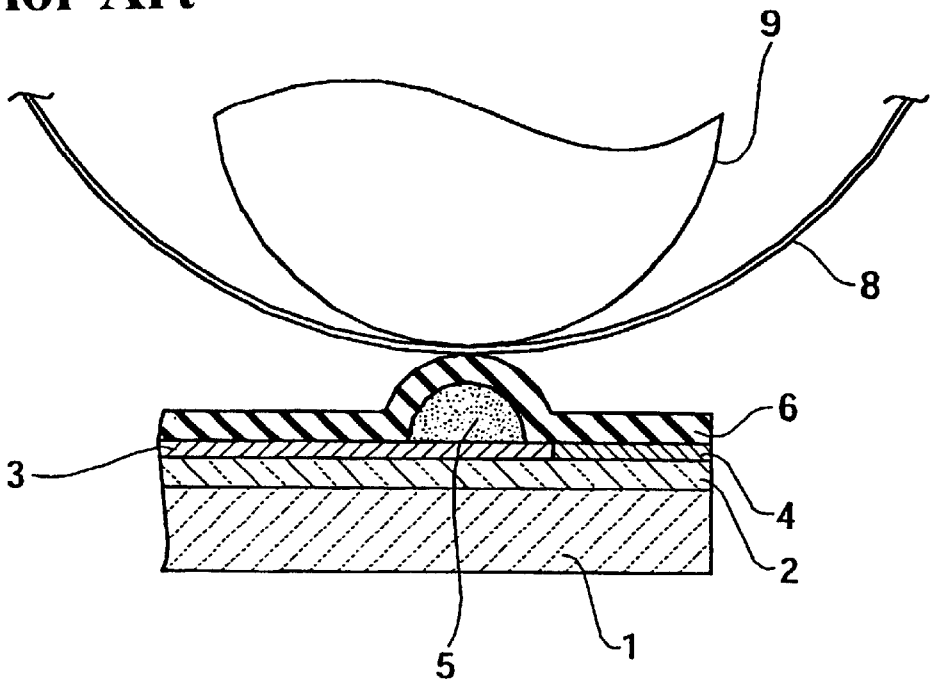
Fig. 9 Prior Art
FIG. 9 is a partial cross sectional view of the thermal head of the prior art.
Figure 10:
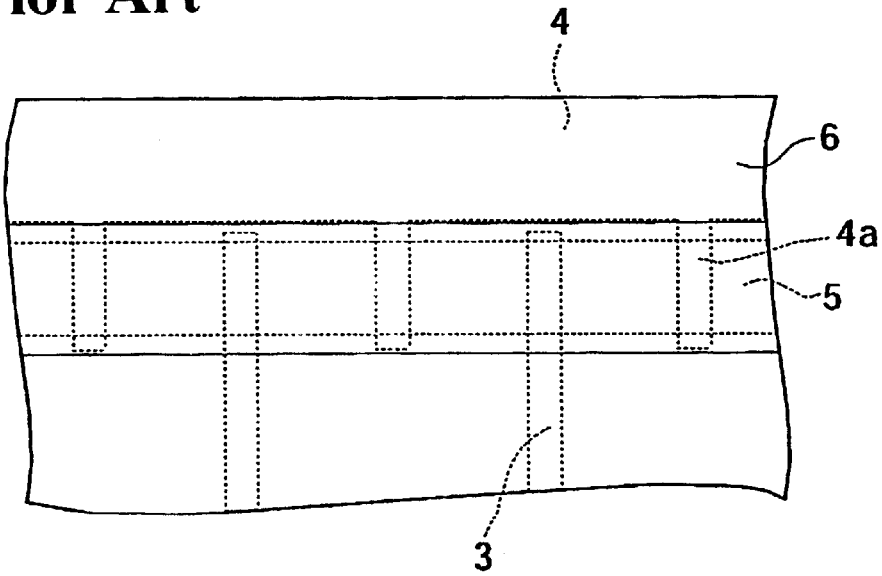
Fig. 10 Prior Art
FIG. 10 is a partial plan view of the thermal head of the prior art.

Further, as shown in FIG. 8 as another embodiment, conductive protective films 7*h* which are connecting portions of the common electrode 4 with the conductive protective film 7 are arranged to have partial surface contact with the common electrode 4 along a portion where the common electrode 4 extends generally parallel to the heating body 5.

According to the present invention, if an electrical connection of the common electrode 4 with the conductive protective film 7 is a surface contact, the effects as explained above are obtained. But it is not affected by a connecting portion or method. In the embodiments as shown in FIGS. 3, 4, 5 and 6, the aforementioned effects are also obtained regardless of the connection of the conductive protective film 7*b*, 7*d*, 7*e* and 7*f*, with the heating body 5, which are connecting portions of the common electrode portions 4*b* with the conductive protective film 7.

Further, in each of the embodiments, it is favorable to use materials with thermal conductivity ratio at 3 or more between the conductive protective film and the insulating protective film.

For example, the conductive protective film 7 employs a material with a thermal conductivity of 9.628 W/mK and the thickness of the film is set at 3 $\mu$m; the protective film 6*a* beneath the film 7 employs a material with a thermal conductivity of 1.616 W/mK and the thickness of the film is set at 7 $\mu$m. Heat from the heating body 5 functions as a thermal insulation by the insulating protective film 6*a*, and the conductive protective film 7 above the heating body 5 can transmit the heat instantly to a printing media, such as thermal sensitive paper, since it has a high thermal conductivity and is constituted to have a superior thermal conductivity which brings excellent thermal response. This excellent thermal response contributes to provide uniform thermal distribution in the heating body.

Figure 11:
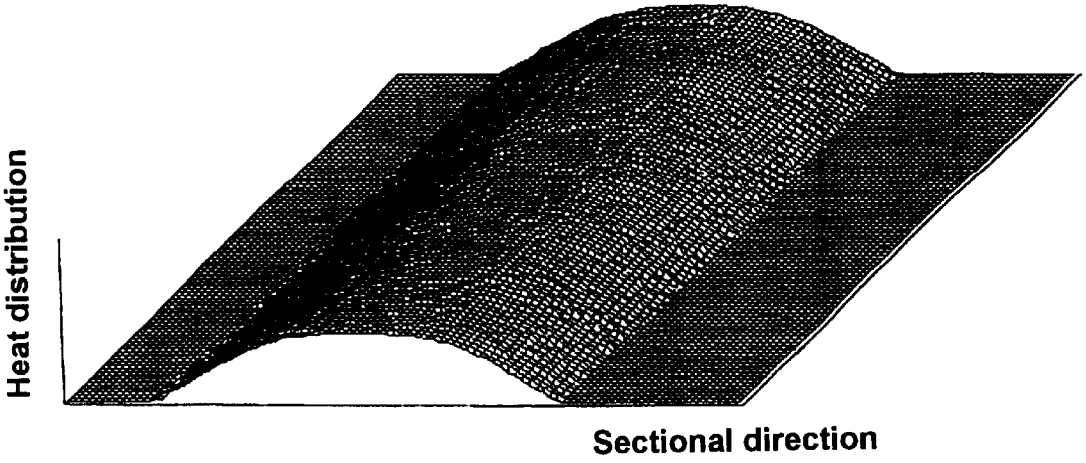
FIG. 11 is a three dimensional view of isothermal distribution of the heating resistor dots of the thermal head according to the present invention.
Figure 12:
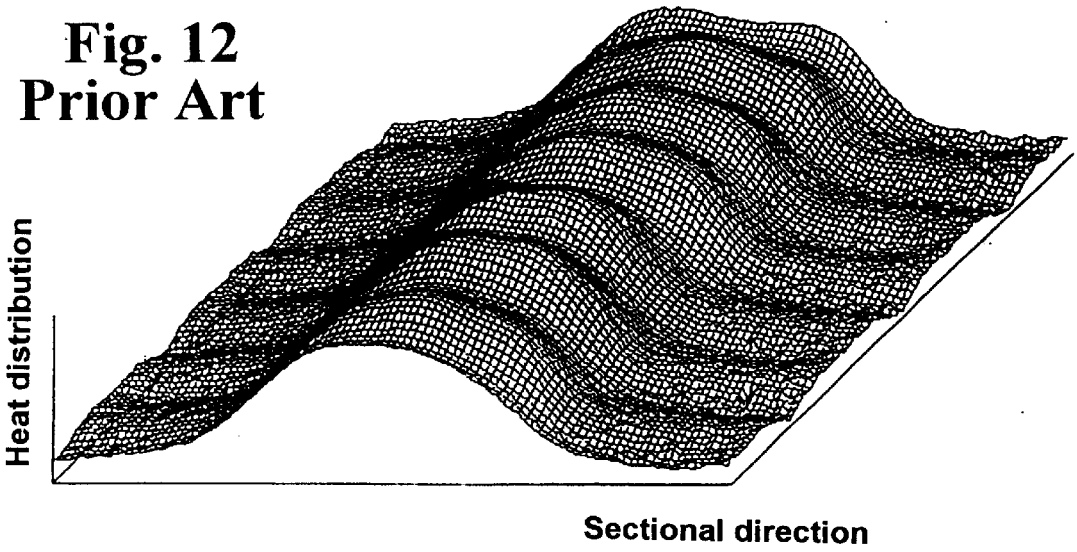
Fig. 12 Prior Art
FIG. 12 is a three dimensional view of isothermal distribution of the heating resistor dots of the thermal head according to the prior art.

Now, FIG. 11 shows thermal distribution in a layer of the heating body of the thermal head according to the present invention while FIG. 12 shows thermal distribution in a layer of a heating body of a thermal head according to the prior art.

In comparison of the both, a peak temperature observed highest at a center of a heating body according to the thermal head of the prior art is found to be lower and averaged in the present invention. The peak temperature is maintained and averaged at a low level which contributes to the coloring, so that the temperature of the conductive protective film 7 is always maintained under the transition point temperature. Thus, the conductive protective film 7 can maintain the prescribed hardness without being softened, and works effectively with good anti-abrasion against mechanical stress due to pressurization of the platen roller caused by carrying of a printing media, such as thermal sensitive paper.

Furthermore, the average temperature of heating in the heating resistance element is suppressed low at a center in the element, while it is adversely averaged high at the side portions in a cross section of the element. Therefore, since an area which contributes to the coloring in the heating resistance element increases, it is possible to realize the coloring size to the same extent with less energy comparing with the thermal head of the prior art.

As described above, the thermal head according to the present invention offers the following effects through formation of a conductive protective film at the most upper layer:

(1) Affect of static electricity caused by charged electricity with the printing media can be prevented as a protective film which is a point of contact with a printing media is made of the conductive material and a portion thereof is connected to the common electrode.

(2) Dielectric breakdown due to electric contact of such sodium ion ($Na^+$) or potassium ion ($K^+$) can be prevented as the protective film which contacts the printing media is made of the conductive material and a portion thereof is connected to the common electrode.

(3) Deterioration due to abrasion with a printing media carried while pressurized by a platen roller can be prevented and anti-abrasion can be improved as a temperature of the protective film which contacts the printing media is maintained at a level which contributes to the coloring and also is suppressed at a lower average level.

(4) Good heat response can be obtained and printing dot size can be formed with less energy as in the case of a thermal head of the prior art as the protective film which contacts the printing media is made of the conductive material.

(5) The thermal head can be manufactured at a lower cost without changing the process according to the prior art as the sintering temperature is higher than the softening temperature when the highest protective layer is formed at a temperature less than the sintering temperature of the protective film just beneath the highest protective layer, the highest protective layer contacting the printing media.

While the invention has been explained with reference to the specific embodiments of the invention, the explanation is illustrative and the invention is limited only by the appended claims.

What is claimed is:

1. A thermal head comprising:

an insulated base plate, individual electrodes, a common electrode and a heating body mounted above the insulated base plate, said heating body extending along the common electrode and said common electrode having common electrode portions extending from two ends thereof to intersect the heating body, an insulating protective film formed on the heating body, and a conductive protective film mounted on the insulating protective film to be connected to the common electrode and having a thermal conductivity greater than that of the insulating protective film, said conductive protective film intersecting the heating body and contacting continuously and directly with the common electrode portions, to thereby form a laminated structure.

2. A thermal head according to claim 1, wherein said conductive protective film is formed of a thick film conductive paste.

3. A thermal head according to claim 1, wherein said conductive protective film is formed of a thick film conductive paste including at least ruthenium.

4. A thermal head according to claim 1, wherein said conductive protective film is formed of a thick film conductive paste including at least ruthenium, sheet resistance of which is 0.5 to 10 MΩ/□.

5. A thermal head according to claim 1, wherein said conductive protective film is formed of a mixture of conductive materials mainly containing ruthenium and insulating materials mainly containing glass.

6. A thermal head according to claim 1, wherein a thermal conductivity ratio between said conductive protective film and said insulating protective film is more than 3.

7. A method of manufacturing a thermal head, comprising:

providing individual electrodes, a common electrode and a heating body above an insulated base plate, forming an insulating protective film on the heating body, and forming a conductive protective film on the insulating protective film to laminate on and connect with the common electrode, said conductive protective film having a thermal conductivity higher than that of the insulating protective film and being sintered at a temperature less than that of the insulating protective film formed under the conductive protective film.

8. A method of manufacturing a thermal head according to claim 7, wherein said conductive protective film is formed of a thick film conductive paste.

9. A method of manufacturing a thermal head according to claim 7, wherein said conductive protective film is formed of a thick film conductive paste including at least ruthenium.

10. A method of manufacturing a thermal head according to claim 7, wherein said conductive protective film is formed of a thick film conductive paste including at least ruthenium and having a sheet resistance of 0.5 to 10 MΩ/□.

11. A method of manufacturing a thermal head according to claim 7, wherein said conductive protective film is formed of a mixture of conductive materials containing mainly ruthenium and insulating materials containing mainly glass.

12. A thermal head comprising:

an insulated base plate, individual electrodes, a common electrode and a heating body mounted above the insulated base plate, said common electrode having common electrode portions extending from two ends thereof to intersect the heating body, an insulating protective film formed on the heating body, and a conductive protective film mounted on the insulating protective film to be connected to the common electrode and having a thermal conductivity greater than that of the insulating protective film, said conductive protective film contacting continuously and directly with the common electrode throughout at least an effective printing area, and contacting continuously and directly with the common electrode portions while intersecting the heating body, to thereby form a laminated structure.

13. A thermal head comprising:

an insulated base plate, individual electrodes, a common electrode and a heating body mounted above the insulated base plate, said common electrode having common electrode portions extending from two ends thereof to intersect the heating body, an insulating protective film formed on the heating body, and a conductive protective film mounted on the insulating protective film to be connected to the common electrode and having a thermal conductivity greater than that of the insulating protective film, said conductive protective film having openings partially formed therein along the common electrode portions and being directly contacted therewith at at least two portions, to thereby form a laminated structure.

14. A thermal head comprising:

an insulated base plate, individual electrodes, a common electrode and a heating body mounted above the insulated base plate, said common electrode having common electrode portions extending from two ends thereof to intersect the heating body, an insulating protective film formed on the heating body, and a conductive protective film mounted on the insulating protective film to be connected to the common electrode and having a thermal conductivity greater than that of the insulating protective film, said conductive protective film having openings partially formed therein along portions throughout an effective printing area and the common electrode portions, and being directly contacted therewith at at least two portions, to thereby form a laminated structure.

15. A method of manufacturing a thermal head, comprising:

providing individual electrodes, a common electrode and a heating body above an insulated base plate, forming an insulating protective film on the heating body, and forming a conductive protective film on the insulating protective film to laminate on and connect with the common electrode, said conductive protective film having a thermal conductivity higher than that of the insulating protective film and being formed of a conductive material with a softening point less than 750° C.

16. A method of manufacturing a thermal head, comprising:

providing individual electrodes, a common electrode and a heating body above an insulated base plate, forming an insulating protective film on the heating body, forming a conductive protective film on the insulating protective film to laminate on and connect with the common electrode, said conductive protective film having a thermal conductivity higher than that of the insulating protective film, and grinding a portion of the conductive protective film located above the heating body.

* * * * *